US008487768B2

(12) United States Patent
Lee et al.

(10) Patent No.: US 8,487,768 B2
(45) Date of Patent: Jul. 16, 2013

(54) ELECTRONIC SEAL EQUIPPED WITH A BREAKAGE-DETECTING CIRCUIT AND METHOD FOR SEALING A DOOR BASED ON THE SAME

(75) Inventors: Ming-Town Lee, Taoyuan County (TW); Feng-Yu Chang, Taoyuan County (TW); Tung-Jung Hsu, Taoyuan County (TW); Chun-Fu Lin, Taoyuan County (TW)

(73) Assignee: Chung-Shan Institute of Science and Technology, Armaments Bureau, Ministry of National Defense, Taoyuan County (TW)

( * ) Notice: Subject to any disclaimer, the term of this patent is extended or adjusted under 35 U.S.C. 154(b) by 181 days.

(21) Appl. No.: 13/220,858

(22) Filed: Aug. 30, 2011

(65) Prior Publication Data

US 2013/0049964 A1 Feb. 28, 2013

(51) Int. Cl.
*G08B 13/14* (2006.01)

(52) U.S. Cl.
USPC ..... 340/572.1; 235/382; 292/2; 340/427; 340/539.26; 340/568.4; 340/572.8; 340/542; 702/65; 713/176

(58) Field of Classification Search
USPC ..... 235/382; 292/2; 340/427, 500, 539.26, 340/542, 568.1, 568.4, 572.1, 572.7, 572.8; 702/65; 713/176
See application file for complete search history.

(56) References Cited

U.S. PATENT DOCUMENTS

| | | | | |
|---|---|---|---|---|
| 6,243,005 | B1 * | 6/2001 | Haimovich et al. | 340/427 |
| 6,420,971 | B1 * | 7/2002 | Leck et al. | 340/542 |
| 7,002,472 | B2 * | 2/2006 | Stratmoen et al. | 340/539.26 |
| 7,135,976 | B2 * | 11/2006 | Neff et al. | 340/572.1 |
| 7,274,289 | B2 * | 9/2007 | Kerr et al. | 340/500 |
| 7,298,274 | B2 * | 11/2007 | Chen et al. | 340/572.8 |
| 7,541,932 | B2 * | 6/2009 | Lee et al. | 340/572.8 |
| 7,597,253 | B2 * | 10/2009 | Lin et al. | 235/382 |
| 7,696,886 | B2 * | 4/2010 | Lai | 340/572.7 |
| 7,956,752 | B2 * | 6/2011 | Henderson | 340/572.8 |
| 2005/0088303 | A1 * | 4/2005 | Allen et al. | 340/568.4 |
| 2005/0174238 | A1 * | 8/2005 | Foseide | 340/568.4 |
| 2008/0211676 | A1 * | 9/2008 | Commagnac et al. | 340/572.8 |
| 2010/0082994 | A1 * | 4/2010 | Wang et al. | 713/176 |
| 2011/0130987 | A1 * | 6/2011 | Chiu et al. | 702/65 |
| 2011/0133932 | A1 * | 6/2011 | Tan et al. | 340/568.1 |
| 2011/0204656 | A1 * | 8/2011 | Lai | 292/2 |

FOREIGN PATENT DOCUMENTS

| | | |
|---|---|---|
| TW | 200604971 | 2/2006 |
| TW | 200936866 | 9/2009 |

* cited by examiner

*Primary Examiner* — Daniel Wu
*Assistant Examiner* — Israel Daramola
(74) *Attorney, Agent, or Firm* — Jackson IPG PLLC

(57) ABSTRACT

Disclosed is an electronic seal for sealing a door. The door is equipped with a latch. The electronic seal includes a plug and a socket. The plug can be inserted in the socket through the latch. Thus, the door is sealed by the electronic seal. The door cannot be opened without breaking the electric seal. The electronic seal records any event of breakage.

10 Claims, 8 Drawing Sheets

ELECTRONIC SEAL EQUIPPED WITH A BREAKAGE-DETECTING CIRCUIT AND METHOD FOR SEALING A DOOR BASED ON THE SAME

BACKGROUND OF INVENTION

1. Field of Invention

The present invention relates to an electronic seal and, more particularly, to an electronic seal equipped with a breakage-detecting circuit for detecting, recording and reporting any event of breakage of the electronic seal.

2. Related Prior Art

An electronic seal based on radio frequency identification ("RFID") and a combinative communication framework for example can be used to seal a container trailer truck or a bond truck so that the security of goods contained in the vehicle and information of the content of the goods can be transmitted and identified. Electronic seals are classified into active electronic seals and passive electronic seals, based on whether they are equipped with batteries. Passive electronic seals can be found in Taiwanese Patents M358380, M328051, M260603 and I289795 for example. These passive electronic seals are disposable, i.e., they cannot be reused. Therefore, these passive electronic seals are not friendly to the environment. Furthermore, these passive electronic seals cannot actively record events of breakage and the points of time of the events of breakage or immediately report the events of breakage via communication device.

An active electronic seal, which includes a battery, generally performs more functions than a passive electronic seal. An active electronic seal can be found in Chinese Patent Application Publication ZL200620047910.6. As disclosed in Chinese Patent Application Publication ZL200620047910.6, the active electronic seal includes a global positioning system ("GPS") module, a microprocessor, a receiver and a transmitter. However, as disclosed in Chinese Patent Application Publication ZL200620047910.6, the active electronic seal includes a disposable plug and socket that cannot be reused so that the cost of the application of the active electronic seal is also high.

Another active electronic seal can be found in U.S. Pat. No. 6,069,563. As disclosed in U.S. Pat. No. 6,069,563, the active electronic seal is equipped with an active-detective circuit for detecting events of breakage. However, as disclosed in U.S. Pat. No. 6,069,563, the active electronic seal is also a one-time disposable device that cannot be reused so that the cost of the application of the active electronic seal is also high.

Furthermore, all mechanical seals are one-time disposable, i.e., they cannot be reused. The mechanical seal can be observed from its outside to determine whether it has been broken.

An electronic seal can be equipped with a breakage detecting and recording apparatus for detecting external parameters such as light, heat and temperature. Such external parameters of a container or a carriage of a bond truck are detected and recorded before and after door sealing, then compare those data to determine whether the door has been opened illegally. An electronic seal can be used together with a GPS and GSM, GPRS, WCDMA or HSDPA communication to position the electronic seal and exchange security and transportation information of goods contained in the container or the carriage.

When an active electronic seal fails, it is often because the battery has run out of electricity or sometimes because the active electronic seal is broken. Hence, it is generally difficult to determine whether an active electronic seal fails because it has run out of electricity or it has been broken or it has been disabled without breakage. However, it is important to determine whether an active electronic seal fails because it has run out of electricity or it has been broken or it has been disabled to determine the security of the container or the carriage in practical usage.

The present invention is therefore intended to obviate or at least alleviate the problems encountered in prior art.

SUMMARY OF INVENTION

It is an objective of the present invention to provide an electronic seal which can detect and record any event of breakage.

To achieve the foregoing objective, the electronic seal includes a plug and a socket. The plug includes a groove, a connector, a rechargeable battery and a radio frequency identification chip. The groove is defined in the plug near an end. The connector is inserted in the plug and formed with a plurality of electric contact points. The rechargeable battery is connected to the connector through wires. The radio frequency identification chip is connected to the connector through wires. The socket includes a shell, a connector, a control and communication circuit, a locking unit and a radio frequency antenna. The shell includes an opening through the plug can be inserted into the shell and locked to the socket. The connector of the socket can be connected to the connector of the plug. The control and communication circuit provides a locking command, receives an encoded command, decodes the encoded command, checks the command, and then provides an unlocking command if there is a match for the command. The control and communication circuit further records any event of breakage of the electronic seal and the point of time of the event of breakage of the electronic seal and actively transmits the record of the event of breakage of the electronic seal to a radio frequency identification reader. The locking unit includes a ring and a horizontally movable bar through the ring so that the bar can be inserted in and moved out of the groove of the plug. The radio frequency antenna is located in the shell for connection to the radio frequency identification chip. An external radio frequency identification reader can read information of security from the radio frequency identification chip when the rechargeable battery fails.

The electronic seal may further include a displaying and warning unit located on the shell for displaying and warning of a low battery, finished sealing, a communication framework and breakage-detecting information based on the working condition of the control and communication circuit.

As the plug is engaged with the socket, the electric contact points of the connector of the plug are in contact with the electric contact points of the connector of the socket so that the radio frequency identification chip of the plug is electrically connected to the radio frequency antenna inserted in the shell of the socket to respond to electromagnetic waves from the external radio frequency identification reader.

When the plug is broken or activated illegally so that the supply of electricity to the radio frequency identification chip is interrupted, the radio frequency identification chip records time of the event of power failure and the event itself.

The electronic seal may further include an extensive shell and a global positioning system element located in the extensive shell for transmitting positioning information to the control and communication circuit shell for filing.

The electronic seal may further include a telecommunication unit inserted in the extensive shell for actively transmitting security information and information of goods through packet protocols of telecommunication network.

The packet protocols of telecommunication network include GPRS, WDCDMA and HSDPA.

The socket and the extensive shell can communicate in two-way with outside independently.

It is another objective of the present invention to provide a method for sealing a door equipped with a latch.

To achieve the foregoing step, the method includes the step of providing an electronic seal as mentioned above and inserting the plug into the socket through the buckle. It is determined whether the supply of electricity to the control and communication circuit from the rechargeable battery is interrupted. In an event of interruption of the supply of electricity to the control and communication circuit from the rechargeable battery, the control and communication circuit records the event and the point of time of the event.

The method may further include the step of providing a telecommunication module to transmit the record to a predetermined receiver.

Other objectives, advantages and features of the present invention will be apparent from the following description referring to the attached drawings.

BRIEF DESCRIPTION OF DRAWINGS

The present invention will be described via detailed illustration of three embodiments referring to the drawings wherein.

DETAILED DESCRIPTION OF EMBODIMENTS

Referring to FIGS. 1 through 5, there is shown an electronic seal 1 with a breakage-detecting circuit in accordance with a first embodiment of the present invention. The electronic seal 1 includes a plug 100 and a socket 200. The plug 100 can be inserted in the socket 200 through a latch of a door (not shown) to seal the door. Thus, the electronic seal 1 provides identification for determining whether the door has been opened illegally.

Figure 1:
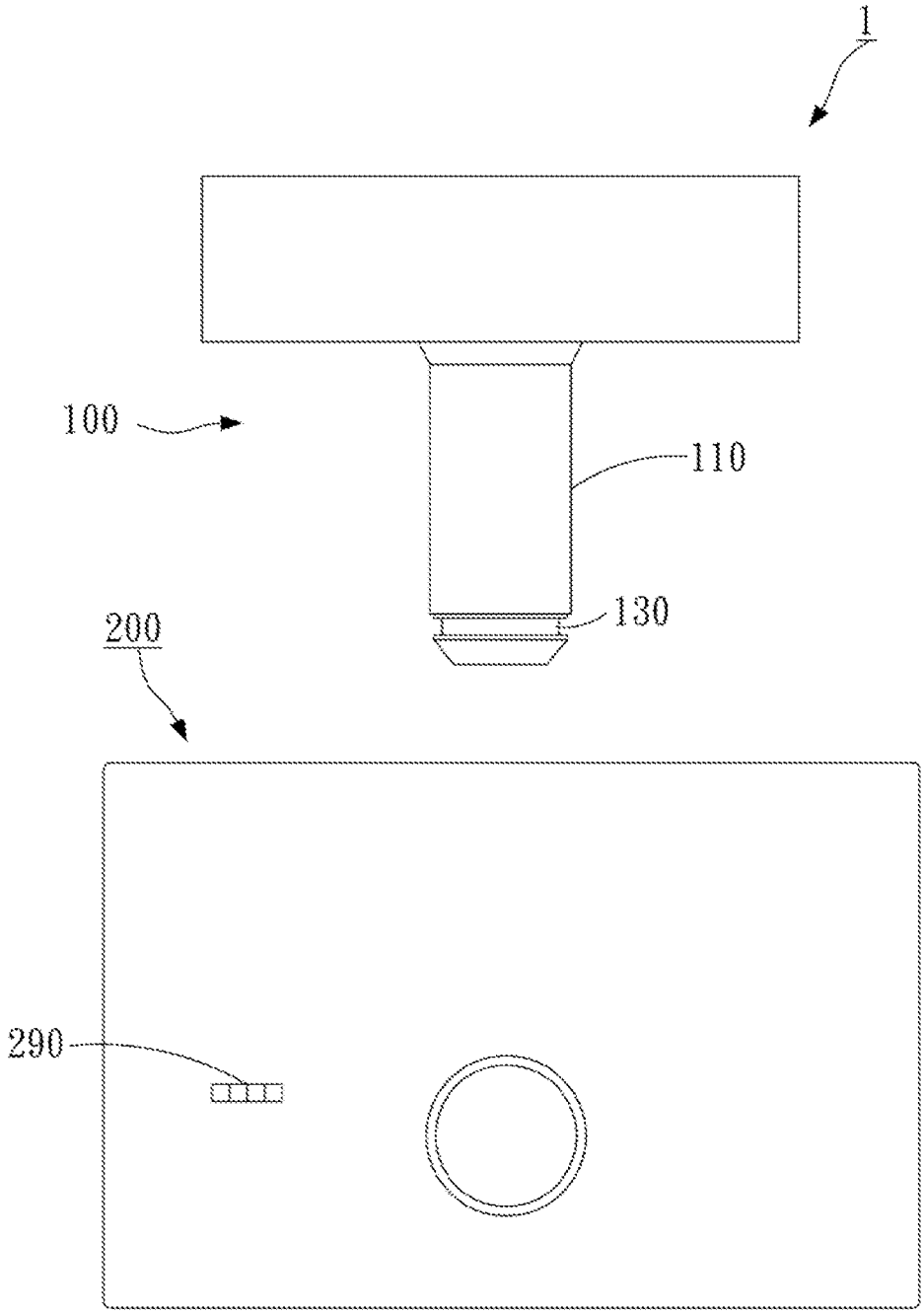
FIG. 1 is a side view of an electronic seal in accordance with the first embodiment of the present invention.
Figure 2:
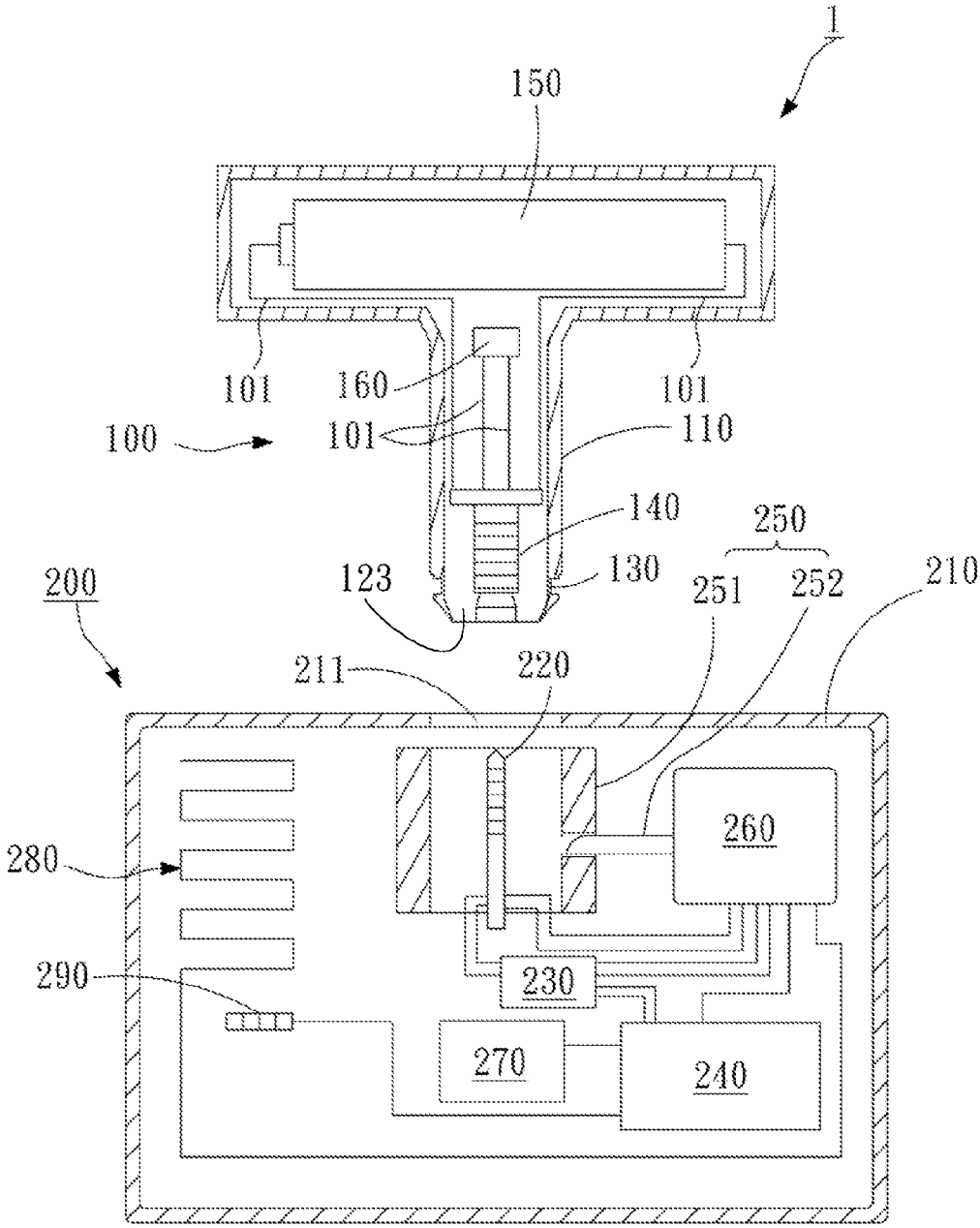
FIG. 2 is a cross-sectional view of the electronic seal shown in FIG. 1.
Figure 3:
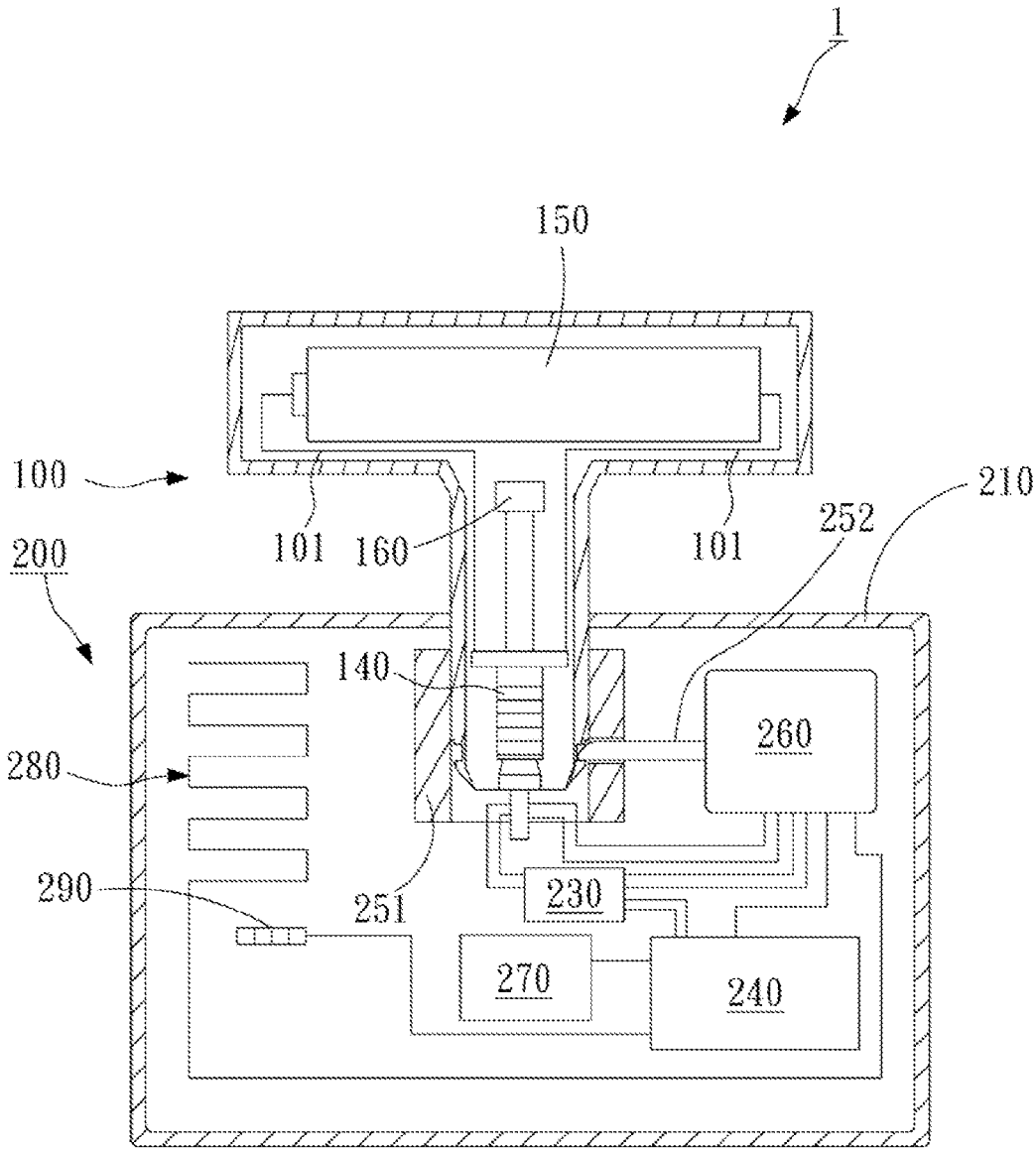
FIG. 3 is a cross-sectional view of the electronic seal in another position than shown in FIG. 2.
Figure 4:
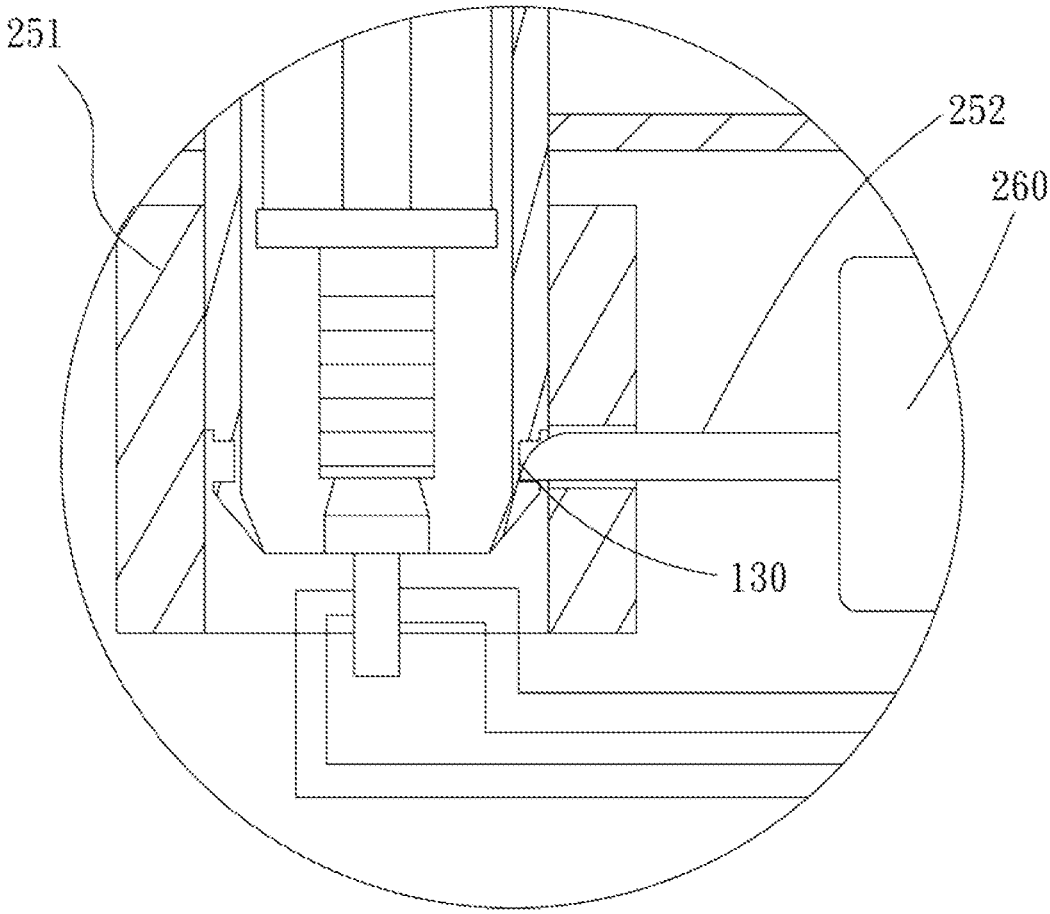
FIG. 4 is an enlarged, partial, cross-sectional view of the electronic seal shown in FIG. 3.
Figure 5:
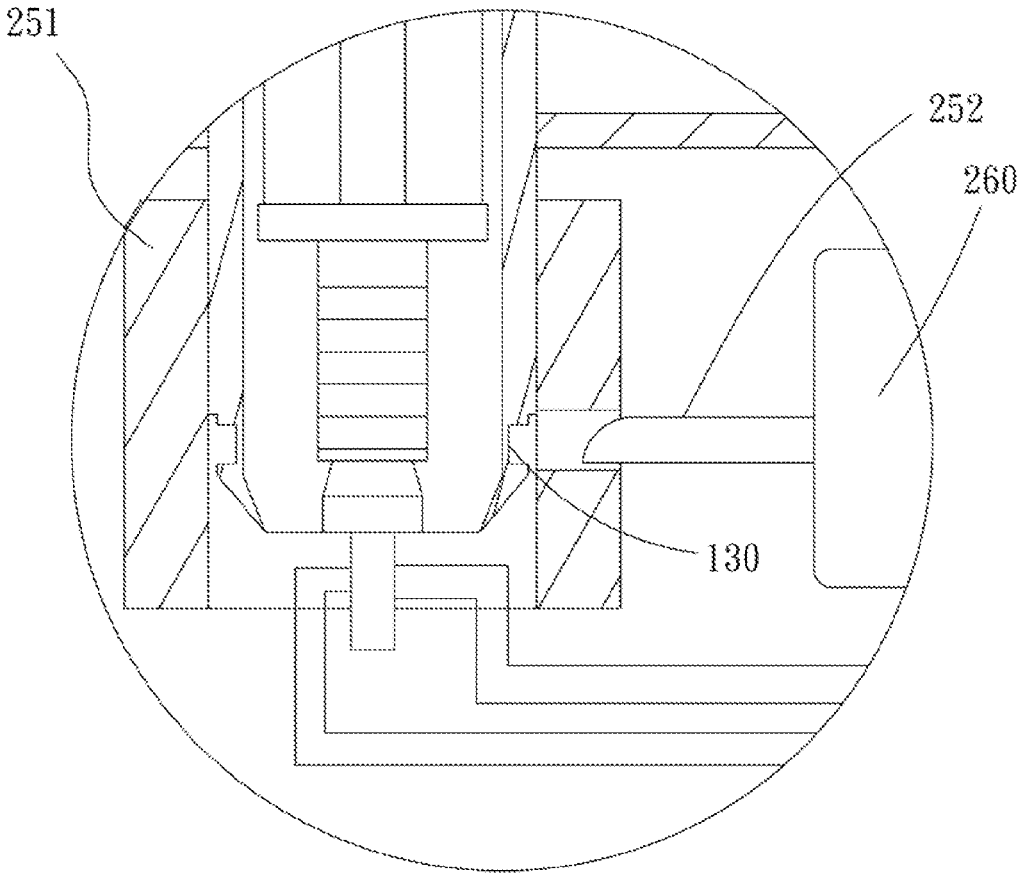
FIG. 5 is a partial, cross-sectional view of the electronic seal in another position than shown in FIG. 4.

Referring to FIGS. 1 through 3, the plug 100 includes a metal shell that may be protectively coated with a plastic layer (not shown). The plug 100 includes at least one groove 130 defined therein near an end thereof. The plug 100 further includes a connector 140 inserted therein. The connector 140 of the plug 100 is formed with a plurality of electric contact points.

Referring to FIGS. 1 and 2, the plug 100 further includes a guiding chamfer 121 formed at the end near which the groove 130 is defined. There may be only one annular groove 130 extending around the plug 100 or a plurality of arched grooves 130 that are separated from one another and arranged around the plug 100. More details of the plug 100 will be given later.

Referring to FIGS. 2 and 3, the plug 100 further includes a rechargeable battery 150 located in a head of the plug 100. The rechargeable battery 150 is wrapped in a plastic layer and used to provide electricity. The rechargeable battery 150 is connected to the electric contact points of the connector 140 of the plug 100 through a plurality of wires 101.

Referring to FIG. 2, the plug 100 further includes an opening 123 defined in the end near which the groove 130 is defined. The opening 123 is direct to an internal space defined in the plug 100. The connector 140 is inserted in the plug 100 corresponding to the opening 123. The connector 140 of the plug 100 is electrically connected to the rechargeable battery 150 through a plurality of wires 101 so that electricity can be provided from the rechargeable battery 150 via the connector 140 of the plug 100.

Referring to FIG. 2, the connector 140 includes a section inserted in the plug 100 and another section extended from the plug 100 through the opening 123. The electric contact points of the connector 140 of the plug 100 are electrically connected to the rechargeable battery 150 for transmitting electricity from the rechargeable battery 150.

Referring to FIG. 2, the plug 100 further includes a radio frequency identification chip 160 inserted therein. The radio frequency identification chip 160 provides a specific code for identification. The radio frequency identification chip 160 is electrically connected to the connector 140 of the plug 100 through some of the wires 101, which are used as signal wires. Thus, the radio frequency identification chip 160 can transmit the specific code through the connector 140 of the plug 100.

Referring to FIGS. 1 through 3, the socket 200 includes a shell 210, a connector 220, a transformer unit 230, a control and communication circuit 240, a locking unit 250, an electric actuator 260, a security switch 270, a radio frequency antenna 280 and a displaying and warning unit 290. The shell 210 is used to contain the connector 220, the transformer unit 230, the control and communication circuit 240, the locking unit 250, the electric actuator 260, the security switch 270, the radio frequency antenna 280 and the displaying and warning unit 290.

Referring to FIG. 2, the shell 210 is made of an insulated plastic material. The shell 210 includes an opening 211 defined therein for receiving the end of the plug 100 near which the groove 130 is defined, thus forming an electronic seal. The locking unit 250 is located corresponding to the opening 211 for locking the plug 100 when the plug 100 is inserted through the opening 211.

Referring to FIGS. 2 and 3, the connector 220 of the socket 200 includes a plurality of electric contact points corresponding to the plurality of electric contact points of the connector 140 of the plug 100 so that the connector 220 of the socket 200 is electrically connected to the connector 140 of the plug 100. As the plug 100 is inserted in the socket 200, the connector 140 of the plug 100 is electrically connected to the connector 220 of the socket 200 so that the rechargeable battery 150 and the radio frequency identification chip 160, which are contained in the plug 100, is electrically connected to the control and communication circuit 240. Moreover, the rechargeable battery 150 is electrically connected to the electric actuator 260 so that electricity is supplied to the control and communication circuit 240 and the electric actuator 260 from the rechargeable battery 150 while the specific code is transmitted to the control and communication circuit 240.

Referring to FIGS. 2 and 3, the transformer unit 230 is located in the shell 210 for transforming the electricity supplied from the rechargeable battery 150 to energize each components of the active electronic seal 1.

Referring to FIGS. 2 and 3, the control and communication circuit 240 is used for transmitting a sealing command and receiving an encoded command signal so that the encoded command signal can be decoded and checked. After checking and affirming the command signal, the control and communication circuit 240 transmits an unsealing command. Moreover, the control and communication circuit 240 records any events of breakage of the electronic seal 1 and the points of time of the events, and actively transmits messages to a radio frequency identification reader.

Referring to FIGS. 2 and 3, in an embodiment, the locking unit 250 includes a ring 251 and at least one bar 252. The bar 252 is horizontally movable through the ring 251 so that the bar 252 can be locked in and moved out of the groove 130 of the plug 100. Preferably, a front end of the bar 252 is made with a crescent form.

Referring to FIGS. 2 and 3, the electric actuator 260 may be a motor, a solenoid or a relay for converting electricity into driving force that is later converted into a rectilinear movement of the bar 252 so that the bar 252 can be locked in or moved out of the groove 130 of the plug 100. After the electric actuator 260 receives the unsealing command from the control and communication circuit 240, the electric actuator 260 moves the bar 252 out of the groove 130. After the electric actuator 260 receives the sealing command from the control and communication circuit 240, the electric actuator 260 moves the bar 252 into the groove 130.

The security switch 270 includes a button provided on the shell 210. After the security switch 270 receives the unsealing command and the button is pushed, the security switch 270 actuates the electric actuator 260 to move the bar 252 out of the groove 130 of the plug 100.

Referring to FIGS. 2 and 3, the radio frequency antenna 280 is inserted in the shell 210. The radio frequency antenna 280 can be engaged with the radio frequency identification chip 160. When the rechargeable battery 150 fails, the radio frequency identification reader reads the radio frequency identification chip 160 to obtain information about the security of the electronic seal 1.

Referring to FIGS. 1 and 2, in use of the electronic seal 1, the plug 100 is inserted through the latch of the door. Then, the plug 100 is inserted into the socket 200 through the opening 211.

Referring to FIGS. 2 and 3, the plug 100 is inserted in the socket 200 so that the connector 140 of the plug 100 is engaged with the connector 220 of the socket 200. Now, the rechargeable battery 150 of the plug 100 provides a voltage which is transformed into a proper voltage by the transformer unit 230. The control and communication circuit 240 is electrically connected to the rechargeable battery 150 so that the control and communication circuit 240 receives electricity from the rechargeable battery 150. The control and communication circuit 240 transmits the sealing command to actuate the electric actuator 260 to move the bar 252 of the locking unit 250 toward the groove 130 of the plug 100.

Now, the rechargeable battery 150 of the plug 100 provides electricity for actuating the electric actuator 260 to move the bar 252 into the groove 130 of the plug 100. When the bar 252 of the locking unit 250 is located in the groove 130 of the plug 100, the control and communication circuit 240 cuts electricity from the electric actuator 260.

Now, to move the plug 100 out of the socket 200, the plug 100 must be moved in a direction extending perpendicular to the axis of the bar 252. The bar 252 stands stress in compliance with high security. Therefore, the state of locking cannot be interrupted unless the electric actuator 260 is actuated to move the bar 252 out of the ring 251.

When the plug 100 is inserted and locked in the socket 200, the plurality of electric contact points of the connector 140 of the plug 100 are electrically connected to the plurality of electric contact points of the connector 220 of the socket 200, and the radio frequency identification chip 160 located in the plug 100 is therefore electrically connected to the radio frequency antenna 280 located in the socket 200, thus forming a radio frequency identification system to respond to radio frequency electromagnetic waves from the radio frequency identification reader.

When the radio frequency antenna 280 receives radio frequency electromagnetic waves from the radio frequency identification reader, the control and communication circuit 240 receives the specific code from the radio frequency identification chip 160 and, in response to the radio frequency antenna 280, transmits radio frequency electromagnetic waves corresponding to the specific code of the radio frequency identification chip 160. Moreover, the control and communication circuit 240 reads information about the security of the electronic seal 1 and information of the transportation of the goods, and transmits radio frequency electromagnetic waves corresponding to the information of the security of the electronic seal 1 and the information about the transportation of the goods to the radio frequency identification reader for inspection of the goods contained in the container or the carriage of the bond truck.

When the plug 100 is engaged with the socket 200 to seal the latch of the container trailer truck or the bond truck, the electronic seal 1 communicates the information about the security of the electronic seal 1 and the information of the transportation of the goods with the radio frequency identification reader, of a fixed type or portable type, through the control and communication circuit 240 of the shell 210. Moreover, the electronic seal 1 communicates the specific code, the information of the security of the electronic seal 1 and the information of the transportation of the goods with the fixed or portable radio frequency identification reader through the radio frequency identification system contained therein.

When the electronic seal 1 is broken, some or all of the wires 101, which connect the plug 100 to the socket 200, are cut. At the moment when at least one of the wires 101 is cut, the control and communication circuit 240 of the socket 200 detects and records the event of a change in the voltage and the point of time of the event in a memory 270. Even if the wires 101 are restored, the event is recorded and transmitted to the radio frequency identification reader. When at least one of the wires 101, used as a power cable or a signal wire, is cut, the event is recorded in the radio frequency identification chip 160. Even if the wire 101 is restored, the event is recorded and transmitted to the radio frequency identification reader. Therefore, the electronic seal 1 exhibits double functions of breakage detection. Based on the event of change in the voltage and the point of time of the event, an inspector can determine whether to open and inspect the container or the carriage of the bond truck. If something is found to be wrong with the container or the carriage as a result of the inspection, the place of the intrusion into the container or the carriage of the bond truck can be traced based on the point of time of the event.

If the rechargeable battery 150 runs out of electricity or the rechargeable battery 150 fails so that inspection cannot be conducted through the electronic seal 1, there is another way for accessing to the specific code of the radio frequency identification chip 160. Another plug 100 can be engaged with the socket 200 to know whether there are any events of change in the voltage and, if any, the points of time of the events recorded in the memory 270, thus determining whether the rechargeable battery 150 has run out of electricity or the rechargeable battery 150 has failed.

Referring to FIGS. 2 and 3, to prevent the rechargeable battery 150 from running out of electricity, the electronic seal 1 may further include a displaying and warning unit 290 provided on the shell 210. Based on the working condition of the control and communication circuit 240, the displaying and warning unit 290 shows and warns of the level of power left in the rechargeable battery 150, the finish of the sealing, the communication framework and the events of breakage. As the plug 100 is inserted in the socket 200, the control and communication circuit 240 detects the level of power left in the rechargeable battery 150, and shows a low battery on the displaying and warning unit 290.

If an inspector wants to inspect a container, a fixed or portable radio frequency identification reader or a remote control center transmits an encoded command. The control and communication circuit 240 of the electronic seal receives and decodes the encoded command. If there is a match for this command, the control and communication circuit 240 transmits an unsealing command to the security switch 270. Before disengaging the plug 100 from the socket 200, the security switch 270 of the electronic seal 1 is operated to determine the current location of the electric actuator 260 and reverse the electric actuator 26 to pull the bar 252 of the locking unit 250 out of the ring 251 of the locking unit 250. Thus, the plug 100 can be moved out of the socket 200 safely without causing any damage so that the electronic seal 1 can be collected and reused.

Figure 6:
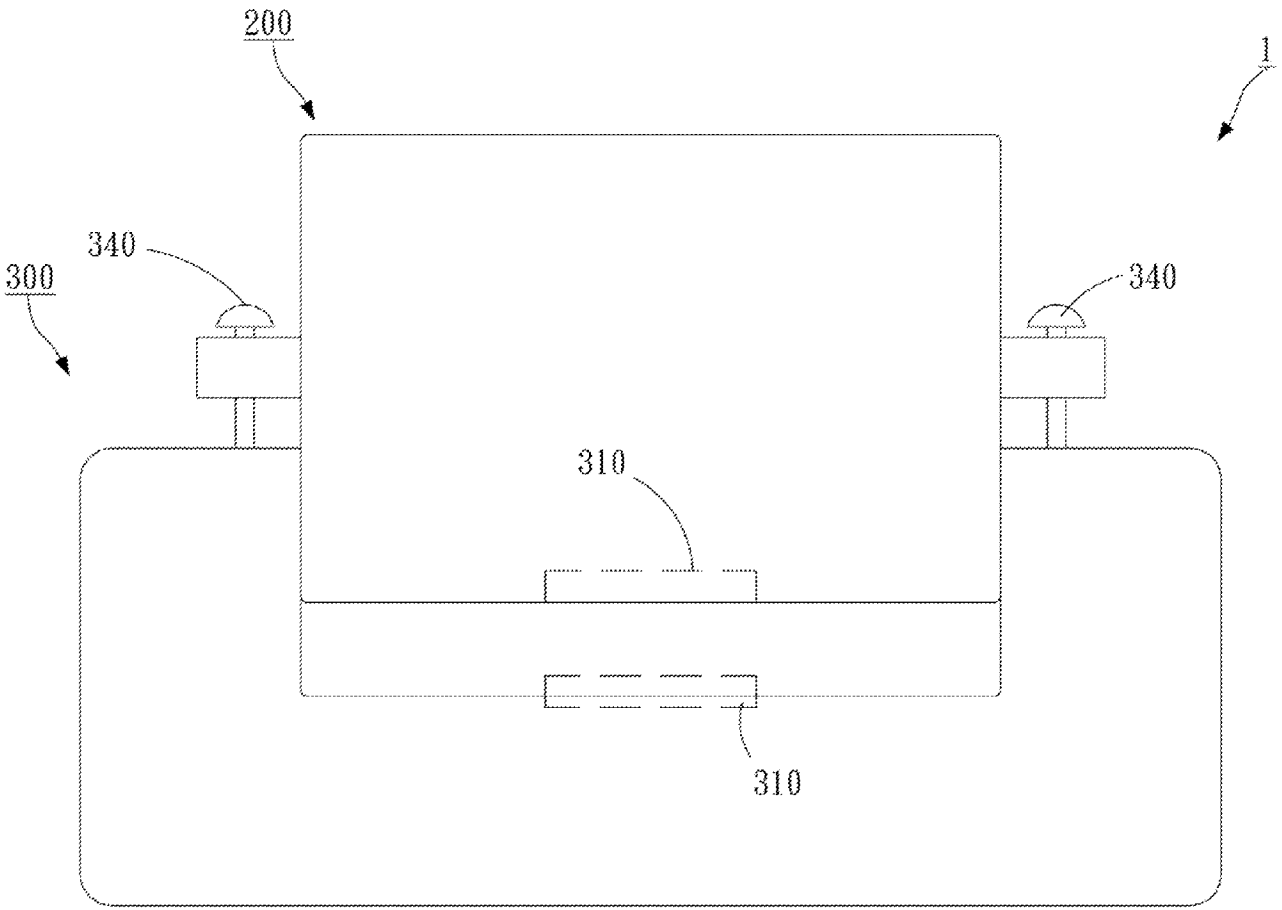
FIG. 6 is a side view of an electronic seal in accordance with the second embodiment of the present invention.
Figure 7:
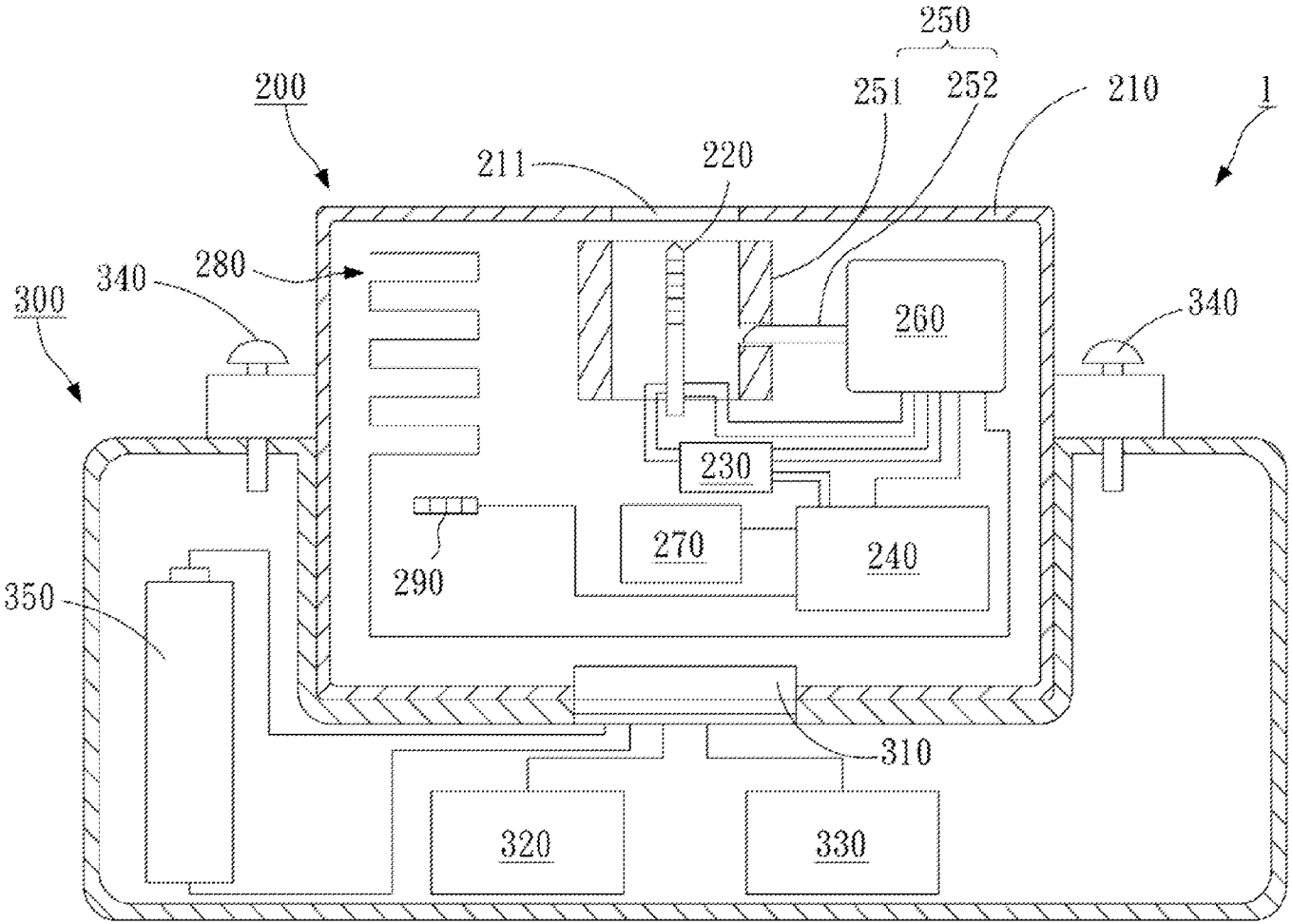
FIG. 7 is a cross-sectional view of the electronic seal shown in FIG. 6.

Referring to FIGS. 6 and 7, there is shown an electronic seal 1 in accordance with a second embodiment of the present invention. The second embodiment is identical to the first embodiment except two things. At first, the socket 200 further includes a bundle 310 of wires. The bundle 310 consists of power wires extending from the plug 100 and signal wires extending from the control and communication circuit 240 for transmitting power and signals to the electronic seal extensive shell 300.

Secondly, the electronic seal 1 includes an extensive shell 300 in addition to the plug 100 and the socket 200. The extensive shell 300 includes a positioning and communicating framework. The extensive shell 300 is connected to the shell 210 of the socket 200 by a plurality of screws 340 and connected to the shell 210 via the bundle 310 of wires of the extensive shell 300. With the positioning and communicating framework of the extensive shell 300, the electronic seal 1 can be used in diverse and combinative communication.

A global positioning system ("GPS") element 320 is located in the extensive shell 300 for obtaining GPS data and transferring the GPS data to the control and communication circuit 240 of the shell 210 for filing and application. Furthermore, there is provided a telecommunication unit 330 located in the extensive shell 300 to transmit the information about the security of the active electronic seal 1 and communicate the information about the transportation of the goods through communication network packet protocols. The communication network packet protocols include GPRS, WDCDMA and HSDPA for instant telecommunication and exchange of information through communication networks. The GPS data can be transmitted through the telecommunication unit 330 for real-time reporting and displaying the position of the electronic seal 1 for visual monitoring. Moreover, a battery 350 can be located in the extensive shell 300 for supplying electricity. Alternatively, the extensive shell 300 is connected to a power supply through the bundle of wires 310 of the shell 210 of the socket 200.

Figure 8:
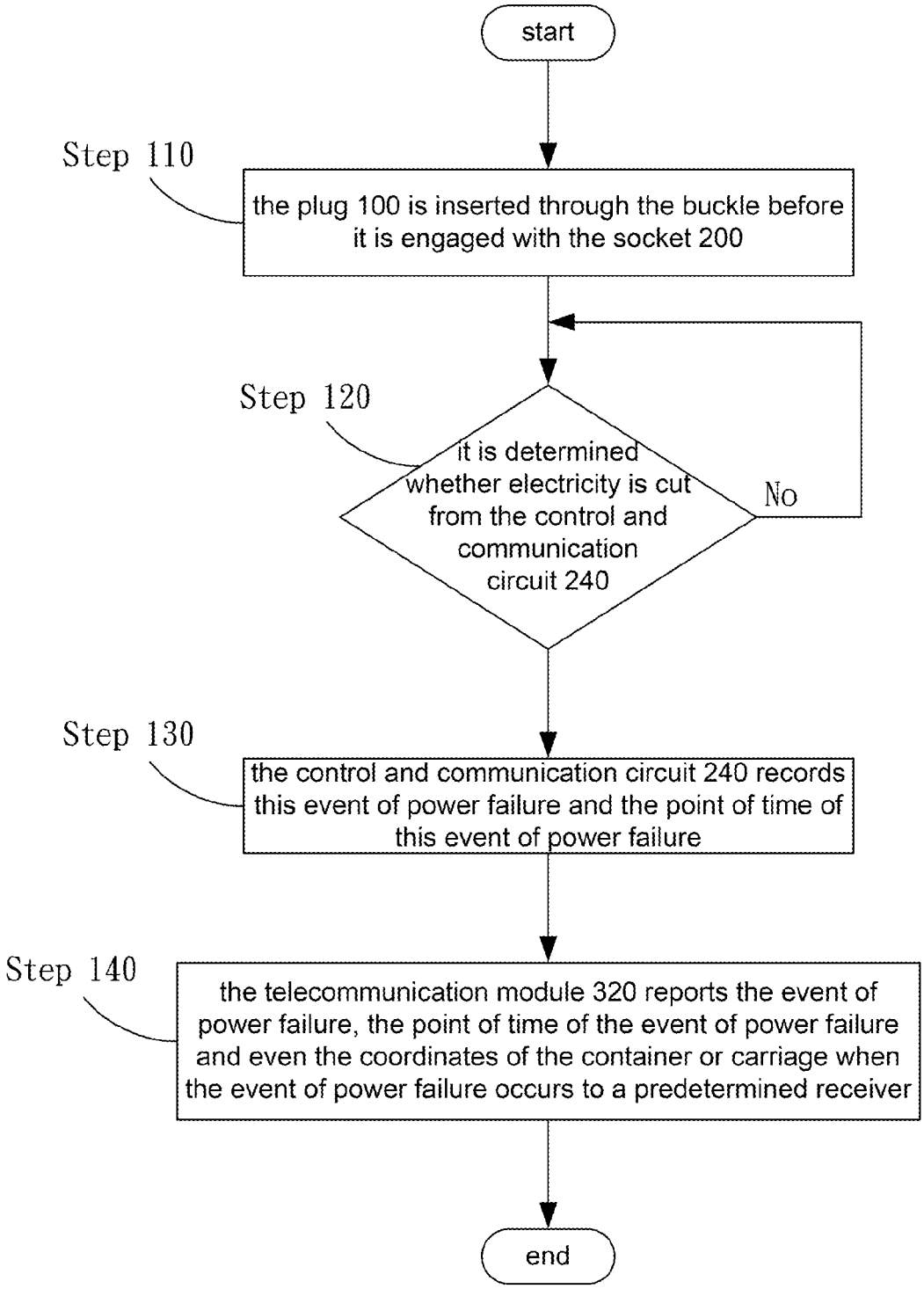
FIG. 8 is a flow chart of a method based on an electronic seal in accordance with the third embodiment of the present invention.

Referring to FIG. 8, there is shown a method for sealing a door of a container or a carriage of a bond truck based on the electronic seal 1 in accordance with a third embodiment. There is a latch provided on the door. The electronic seal 1 is inserted through the latch and locked on the latch so that the container or carriage is sealed.

In the method, at Step 110, the plug 100 is inserted through the latch before it is engaged with the socket 200.

Step 120, it is determined whether electricity is cut from the control and communication circuit 240. If so, the process goes to Step 130. Otherwise, the process stays at Step 120.

At Step 130, as the provision of electricity from the rechargeable battery 150 to the control and communication circuit 240 is interrupted, the control and communication circuit 240 records this event of power failure and the point of time of this event of power failure.

Thus, when the electronic seal 1 is broken or accidentally disengaged from the latch, based on the record of the event of power failure and the point of time of the event of power failure, the container or carriage can be inspected, and the location of the container or carriage when the event of power failure occurs can be traced.

At Step 140, as an event of power failure occurs, the telecommunication module 320 reports the event of power failure, the point of time of the event of power failure and even the coordinates of the container or carriage when the event of power failure occurs to a predetermined receiver. Thus, instant inspection can be conducted on the container or carriage.

As discussed above, the electronic seal 1 that is broken or accidentally disengaged from the latch can instantly be identified. Moreover, through the instant report, the container or carriage can quickly be identified and located so that instant inspection can be conducted on the container or carriage.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. An electronic seal including:

a plug including:

a groove defined therein near an end;

a connector inserted in the plug and formed with a plurality of electric contact points;

a rechargeable battery connected to the connector via wires; and a radio frequency identification chip connected to the connector through wires; and a socket including:

a shell including an opening in which the plug can be inserted into the shell and locked to the socket;

a connector for connection to the connector of the plug;

a control and communication circuit for providing a sealing command, receiving an encoded command, decoding the encoded command, checking the command, and providing an unsealing command if there is a match for the command, wherein the control and communication circuit further records any event of breakage of the electronic seal and the point of time of the event of breakage of the electronic seal and actively transmits the record of the event of breakage of the electronic seal to a radio frequency identification reader;

a locking unit including a ring and a bar horizontally movable through the ring so that the bar can be inserted in and moved out of the groove of the plug; and a radio frequency antenna located in the shell for connection to the radio frequency identification chip, wherein an external radio frequency identification reader can read information of security from the radio frequency identification chip when the rechargeable battery fails.

2. The electronic seal in accordance with claim 1, further including a displaying and warning unit located on the shell for displaying and warning of a low battery, finished sealing, a communication framework and breakage-detecting information, based on the working condition of the control and communication circuit.

3. The electronic seal in accordance with claim 1, wherein as the plug is engaged with the socket, the electric contact points of the connector of the plug are in contact with the electric contact points of the connector of the socket so that the radio frequency identification chip of the plug is electrically connected to the radio frequency antenna inserted in the shell of the socket to respond to radio frequency electromagnetic waves from the external radio frequency identification reader.

4. The electronic seal in accordance with claim 1, wherein when the plug is broken or accidentally disengaged so that the supply of electricity to the radio frequency identification chip from the rechargeable battery is interrupted, the radio frequency identification chip records the event of power failure and the point of time of the event of power failure.

5. The electronic seal in accordance with claim 1, further including an extensive shell and a global positioning system element located in the extensive shell for transmitting positioning information to the control and communication circuit shell for filing.

6. The electronic seal in accordance with claim 5, further including a telecommunication unit inserted in the extensive shell for actively transmitting security information and communicating goods-related information through telecommunication network packet protocols.

7. The electronic seal in accordance with claim 6, wherein the telecommunication network packet protocols include GPRS, WDCDMA and HSDPA.

8. The electronic seal in accordance with claim 6, wherein the socket and the extensive shell can communicate with outside independently.

9. A method for sealing a door equipped with a latch, the method including the steps of:

providing an electronic seal as set forth in claim 1 and inserting the plug into the socket through the latch;

determining whether the supply of electricity from the rechargeable battery to the control and communication circuit is interrupted;

in an event of interruption of the supply of electricity from the rechargeable battery to the control and communication circuit, using the control and communication circuit to record the event and the point of time of the event.

10. The method in accordance with claim 9, further including the step of providing a telecommunication module to transmit the record to a predetermined receiver.

* * * * *